United States Patent [19]

Nishida et al.

[11] Patent Number: 4,617,843

[45] Date of Patent: Oct. 21, 1986

[54] ELECTRICALLY-OPERATED DRIVER

[75] Inventors: Yoshikazu Nishida, Hirakata; Isamu Hashimoto, Katano, both of Japan

[73] Assignee: Matsushita Electric Industrial Co., Ltd., Osaka, Japan

[21] Appl. No.: 796,764

[22] Filed: Nov. 12, 1985

[30] Foreign Application Priority Data

Nov. 16, 1984 [JP] Japan ..... 59-242836

[51] Int. Cl.[4] ..... B25B 17/00

[52] U.S. Cl. ..... 81/57.11; 81/429; 81/469

[58] Field of Search ..... 81/57.14, 57.11, 57.12, 81/57.13, 469, 429

[56] References Cited

U.S. PATENT DOCUMENTS

| | | | |
|---|---|---|---|
| 1,711,520 | 5/1929 | Decker | 81/57.14 |
| 2,796,161 | 6/1957 | Graybill | 81/429 |
| 2,979,089 | 4/1961 | Piesker | 81/57.11 |
| 3,866,493 | 2/1975 | Ringerud | 81/57.11 |

FOREIGN PATENT DOCUMENTS

| | | | |
|---|---|---|---|
| 376638 | 7/1932 | United Kingdom | 81/57.14 |

*Primary Examiner*—James L. Jones, Jr.

*Attorney, Agent, or Firm*—Stevens, Davis, Miller & Mosher

[57] ABSTRACT

An electrically-operated driver is constructed such that when a screw begins to be driven, axial movements of a bit is transmitted to a switch mounted on a reduction gear, which engages with a shaft of an electric motor, to turn on or off the switch. In the driver, a distance between the switch and a clutch bearing a thrust from the bit is made short so as to eliminate scattering in strokes required for actuating the switch, which scattering would be produced by axial accumulative errors of parts constituting an actuating mechanism for the switch. Accordingly, movements of the bit are transmitted to the switch with certainty to stably start and stop the motor of the electrically-operated driver.

5 Claims, 9 Drawing Figures

ELECTRICALLY-OPERATED DRIVER

BACKGROUND OF THE INVENTION

This invention relates to a push-start type electrically-operated driver which is a manual electrically-operated tool suitable for use in tightening screws and nuts.

Recently, push-start type electrically-operated drivers have been widely used, in which driver an electric motor is rotated upon pushing a bit against a screw and an electric power source is cut off from the motor upon actuation of a clutch when the screw is tightened with a predetermined torque.

An example of a prior push-start type electrically-operated driver will be described hereinbelow with reference to FIG. 9, in which there is generally shown a prior push-start type electrically-operated driver (for details, see Japanese Patent Examined Publication No. 2036/75). In FIG. 9, reference numerals 1, 2 and 3 designate an electric motor, a planetary reduction gear and a clutch, respectively. These elements are covered by a cover 4. Reference numeral 5 designates a switch rod which extends through the planetary reduction gear 2 and motor 1 and is contacted by a switch 7 via a pin 6. The switch 7 serves to rotate and stop the motor 1. Reference numeral 8 designates a bit which is pushed against a screw upon tightening thereof to cause the mechanism of clutch 3 to move the switch rod 5 in the direction shown by arrow a for flipping the switch 7. When the screw experiences a predetermined torque, the clutch 3 causes the switch rod 5 to be moved in the direction of arrow b, so that the switch 7 is turned off to stop the electric motor 1.

With the prior arrangement described above, however, the shaft of the motor 1 must be hollow so as to pass the switch rod 5 therethrough, which is quite disadvantageous in terms of the manufacturing cost and rigidity in the case of electric motors having a large length. In addition, the longer the switch rod 5 the larger the curvature thereof becomes, so that its sliding movement through the motor shaft and the planetary reduction gear is not smooth to make switching unstable. Furthermore, the state of things in the prior art is that even if the switch rod 5 extending through the motor 1, planetary reduction gear 2 and clutch 3 is good in precision with respect to its longitudinal dimension, the switch 7 is excessively or insufficiently pushed by the rod 5 due to the accumulative errors produced by tolerances of parts dimensions of the three elements, that is, the motor 1, planetary reduction gear 2 and clutch 3.

SUMMARY OF THE INVENTION

The invention is intended for resolving the above problems of the prior art. According to the invention, there is provided an electrically-operated driver, in which a switch rod is made short to the utmost and a switch is disposed between an electric motor and a reduction gear close to a clutch section to thereby eliminate any scattering in actuation strokes of the switch which scattering is produced by the above accumulative errors, and in which a shaft of the motor is made solid to be advantageous in its rigidity and manufacturing cost.

To solve the above problems, an electrically-operated driver of the invention includes a reduction mechanism consisting of double-intermediate gears in planetary arrangement devoid of an internal gear in place of a prior planetary reduction gear and an actuating mechanism disposed between an electric motor and a reduction gear for actuating a switch in response to axial movements of a bit.

In the constitution of the invention, the distance between a switch and a switch rod extending to a clutch section is made short so as to eliminate any scattering in actuation strokes of the switch, which scattering would be produced by axially accumulative errors of the above constituent parts, and a switching operation section is provided on a reduction gear, which section transmits movement of a switch rod to a switch with certainty so that a short switch rod can put on or off the switch, and the switch is disposed between an electric motor and the reduction gear so as to make a shaft of the motor solid.

DESCRIPTION OF THE PREFERRED EMBODIMENT

A preferred embodiment of an electrically-operated driver in accordance with the invention will now be described by referring to the accompanying drawings.

Figure 1:
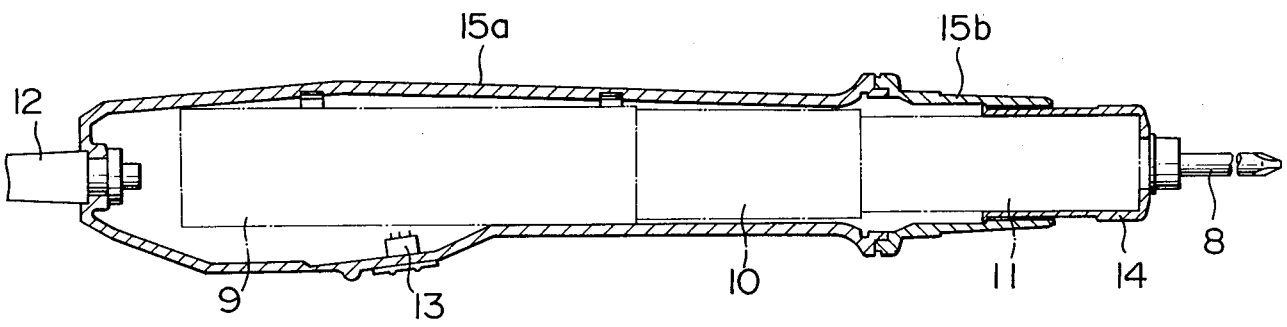
FIG. 1 shows generally an electrically-operated driver according to an embodiment of the invention.

FIG. 1 shows the electrically-operated driver according to one embodiment of the invention, in which the numerals 8, 9, 10, 11, 12, 13 and 14 designate a bit, an electric motor, a reduction gearing, a clutch, an input cord connected to a power source, a switch for altering the direction of rotation of the bit 8, and a nut for adjusting the torque of the clutch 11, respectively. The numerals 15*a* and 15*b* designate covers for enclosing the aforesaid parts of the driver.

Figure 2:
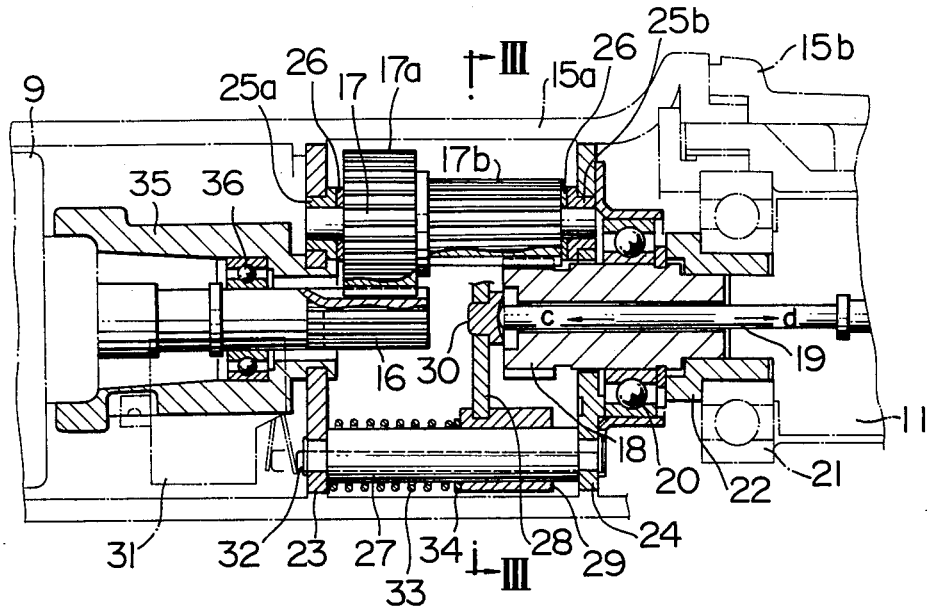
FIG. 2 is a fragmentary sectional view of a reduction gear incorporated into a first embodiment of the invention.

FIG. 2 shows the reduction gearing 10 incorporating therein one constructional form of the switch operating means. The numeral 16 designates a motor gear meshing with a plurality of intermediate gears 17, each of which comprises a first-stage gear portion 17*a* and a second-stage gear portion 17*b* formed integral with each other. An output gear 18 meshing with the second-stage gear portions 17*b* of the intermediate gears 17 has, slidably inserted in a central portion thereof, a switch rod 19 which extends through the clutch 11. The output gear 18 is journalled at its body by a bearing 20, and rotatably connected at its forward end portion to the clutch 11 via a coupling journalled by a bearing 21 in the clutch 11. The intermediate gears 17 are supported at opposite ends thereof by bushes 25*a* and 25*b* force fitted in upper and lower plates 23 and 24 respectively and compensated by a thrust washer 26 for axial play. A plurality of guide poles 27 which are offset are fitted in place between the upper and lower plates 23 and 24. A plurality of bushes 29 fitted to a slide plate 28 interposed between the motor gear 16 and output gear 18 each move in sliding movement over one of the guide poles 27. A center bush 30 against which one end face of the switch rod 19 abuts is force fitted in the slide plate 28, and a rod 32 for pressing a switch 31 is force fitted and secured in one portion of the slide plate 28. The numerals 33 an 34 designate compression springs and spring seats vely. The numeral 35 designates a housing constructed to provide a unitary structure with the upper plate 23 to support a bearing 36 therein.

Figure 3:
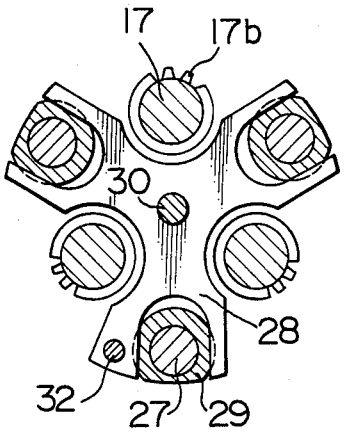
FIG. 3 is a sectional view taken along the line III—III in FIG. 2.

FIG. 3 is a sectional view taken along the line III—III in FIG. 2, in which the bushes 29 are held against rotation relative to the guide poles 27 and able to move slightly toward and away from the central portion of the slide plate 28.

Figure 4:
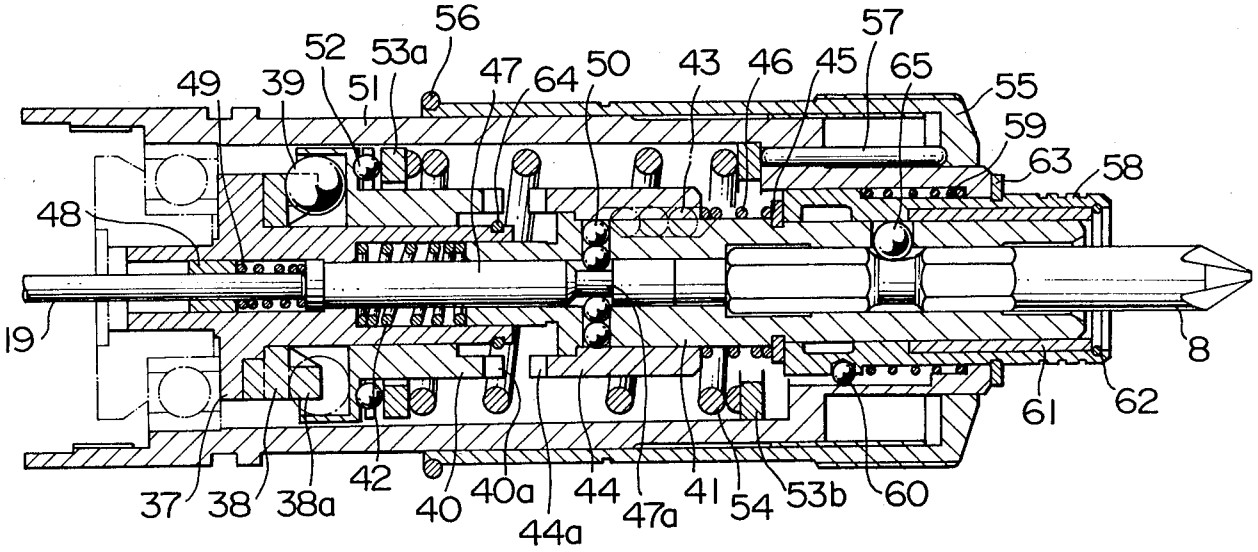
FIGS. 4 to 6 are sectional views of the essential parts of the first embodiment for illustrating the section of a clutch incorporated thereinto.

In FIG. 4 showing the clutch 11, a cam shaft 37 supports a ring cam 38. A hammer ring 40 having, in its groove, balls 39 adapted to move up and down a cam slope 38*a* of the ring cam 38 is slidably fitted over the cam shaft 37. A bit holder 41 is fitted in a center bore of the cam shaft 37, and a return spring 42 is mounted between the bit holder 41 and cam shaft 37. The bit holder 41 is provided with a claw retainer 44 which is able to move axially in sliding movement but prevented from rotating about its own axis by steel balls 43. The claw retainer 44 is formed at one end thereof with a claw 44*a* adapted to come into meshing engagement with a claw 40*a* at one end of the hammer ring 40. A reset spring 46 is mounted between the claw retainer 44 and a stop ring 45 located in the vicinity of a central portion of the bit holder 41. A lock spring 49 is mounted in the center bore of the cam shaft 37 between a left end face of a lock cam 47 fitted in the center bore of the cam shaft 37 and a center bore of the bit holder 41 and a cam shaft bush 48 force fitted in the cam shaft 37. The switch rod 19 extends axially through a central portion of the cam shaft bush 48 to the switch 31 shown in FIG. 2. Steel balls 50 received in a radial bore formed in the bit holder 41 are in contact with a head 47*a* of the lock cam 47. The numeral 51 designates a clutch case for covering the clutch 11. A torque spring 54 is mounted between an inner wall surface of the clutch case 51 and the hammer ring 40 and extends between a spring seat 53*a* journalled by a thrust bearing 52 and a spring seat 53*b*. The numeral 55 designates a torque adjusting nut threadably fitted over the clutch case 51 and having a ring 56 at a left end thereof. A plurality of pins 57 are located in the clutch case 51 and press the spring seat 53*b* as the torque adjusting nut 55 moves. The numeral 58 designates a knob attached to the clutch case 51, with a knob spring 59 being interposed between the clutch case 51 and knob 58. The knob 58 is prevented from rotation relative to the clutch case 51 by steel balls 60 and has a bush 61 force fitted in a forward end portion thereof and prevented from being dislodged therefrom by a ring 62. The numerals 63, 64 and 65 designate a stop ring fitted over the knob 58, a stop ring fitted over the cam shaft 37 and steel balls for preventing the dislodging of the bit 8, respectively. When the bit 8 is forced against a screw (not shown) the claw 44*a* of the claw retainer 44 is brought into meshing engagement with the claw 40*a* of the hammer ring 40 and moves the switch rod 19, with the result that the switch 31 is actuated and causes the motor 9 to start rotating.

Operation of the electrically-operated driver of the aforesaid construction will be described by referring to the drawings.

As the bit 8 is forced against a screw (not shown) and moves in the direction of an arrow c in FIG. 2, the switch rod 19 also moves in the same direction through the clutch 11 and presses the center bush 30 to move the slide plate 28. This causes the rod 32 secured to the slide plate 28 to move the equal distance, thereby actuating the switch 31. As a result, the motor 9 starts rotating and the torque of the motor 9 is transmitted via the motor gear 16 and intermediate gears 17 to the output gear 13 after the speed of rotation is reduced and the rotational force is increased, so that the torque is transmitted to the clutch 11.

Figure 5:
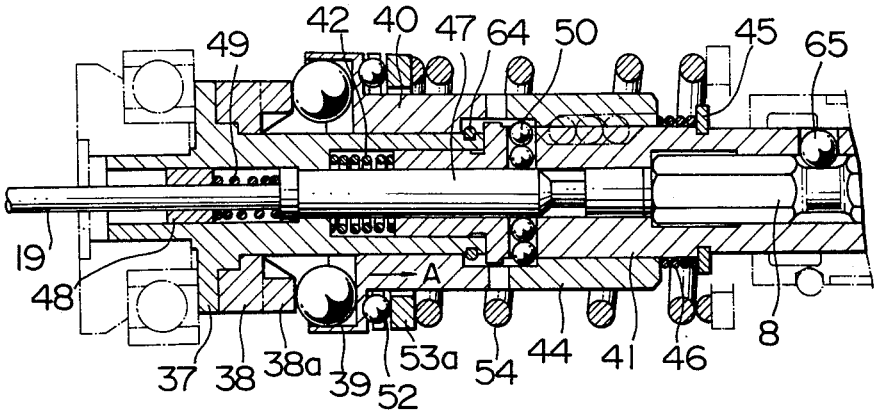
Figure 6:
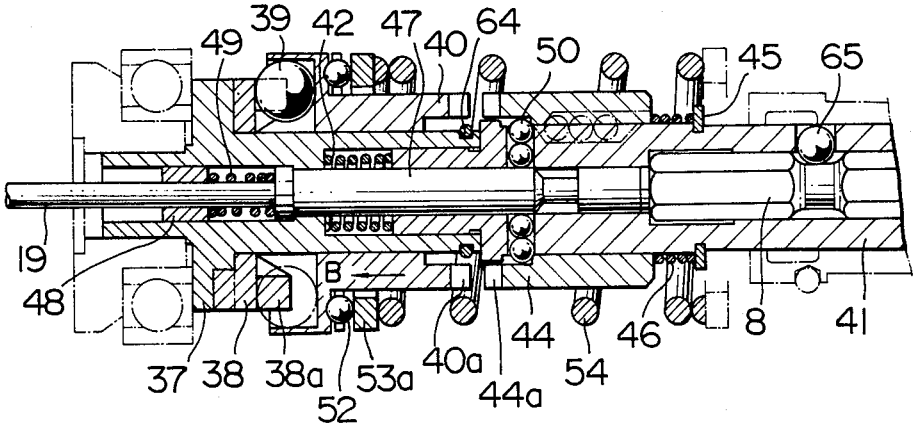

Referring to FIG. 5, as the torque applied to the screw reaches a predetermined level, the bit 8, bit holder 41 and claw retainer 44 become stationary, but the motor 9 tends to continue rotating, so that the drive force transmitted from the motor 9 via the reduction gearing 10 is transmitted to the cam shaft 37 to rotate the ring cam 38. This causes the steel balls 39 to move to the highest position on the cam slope 38*a* of the ring cam 38 and biases the hammer ring 40 in the direction of an arrow A, so that the hammer ring 40 pushes at its right end the claw retainer 44 rightwardly in FIG. 5. At this time, the steel balls 50 are moved by the biasing force of the lock spring 49 which urges the lock cam 47 to move and released from contact with the head 47*a* of the lock cam 47, so that the steel balls 50 fully enter the radial bore of the bit holder 41. Thus, the switch rod 19 returns to its original position, and the slide plate 28 is urged by the biasing forces of the compression springs 33 to move and turn off the switch 31 and cause the motor 9 to stop rotating (see FIG. 2). When the steel balls 39 have moved over the highest position on the cam slope 38*a* as shown in FIG. 6, the hammer ring 40 moves in the direction of an arrow B. Meanwhile, the claw retainer 44 is prevented by the steel balls 50 from returning to its original position, so that the claws 30*a* and 44*a* are brought out of meshing engagement with each other. This prevents the drive force from being transmitted to the bit 8.

In the electrically-operated driver of the aforesaid construction in which the reduction gearing incorporates therein one constructional form of the switch operating means, the amount of a shift of the switch rod 19 can be positively transmitted to the switch 31 by bringing the switch rod 19 into abutting engagement with the center bush 30 force fitted in the slide plate 28 which, moving in sliding movement over the guide poles 27 interposed between the upper and lower plates 23 and 24, has the rod 32 secured to one portion thereof.

Another constructional form of the switch operating means incorporated in the reduction gearing of the electrically-operated driver according to the invention will be described by referring to FIGS. 7 and 8.

The switch operating means shown in these figures is distinct from the switch operating means shown in FIG. 2 in that the switch rod 19 abuts against a lever 66 adapted to move in pivotal movement about a shaft 71 supported by a block 69 secured by screws 68 to posts 67 between the upper and lower plates 23 and 24 and fixed in place by a ring 70. The pivotal movement of the lever 66 causes a pin 72 to move in sliding movement in the block 69 against the biasing force of a compression spring 73, so that the pin 72 turns on and off the switch 31.

Operation of the electrically-operated driver having the reduction gearing incorporating therein the switch operating means of the construction shown in FIGS. 7 and 8 will be described.

Figure 7:
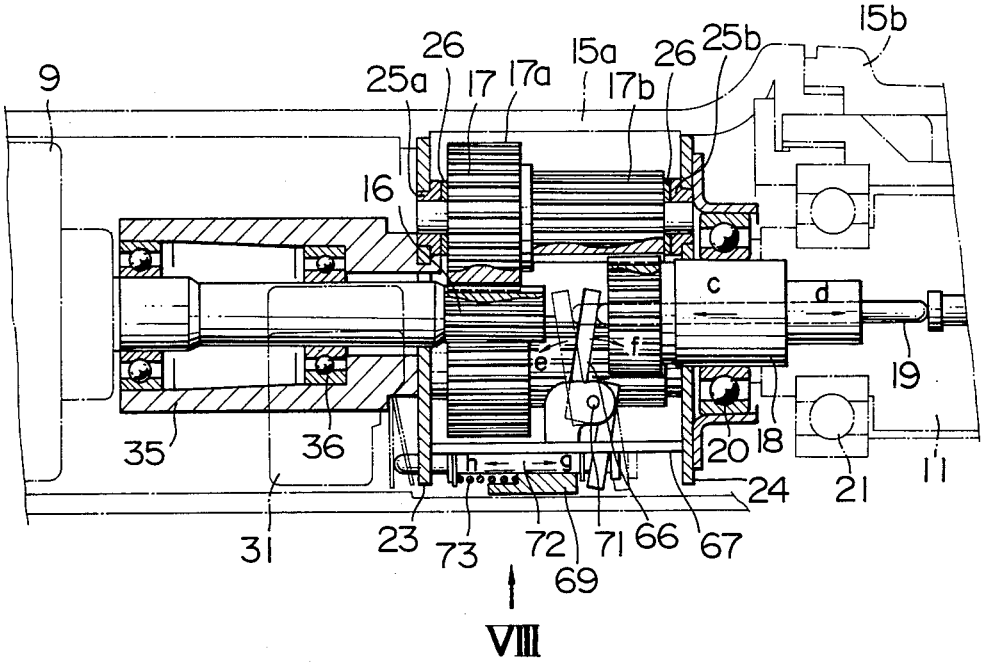
FIG. 7 is a sectional view of an entire reduction gear of a second embodiment of the invention.
Figure 8:
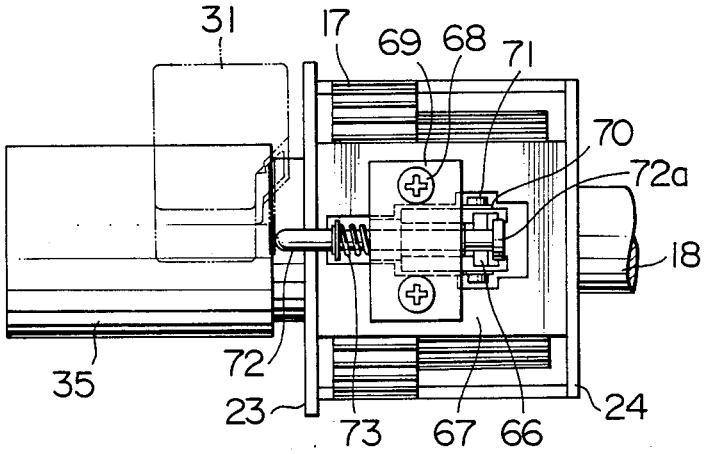
FIG. 8 is a sectional view taken along the line VIII—VIII in FIG. 7.
Figure 9:
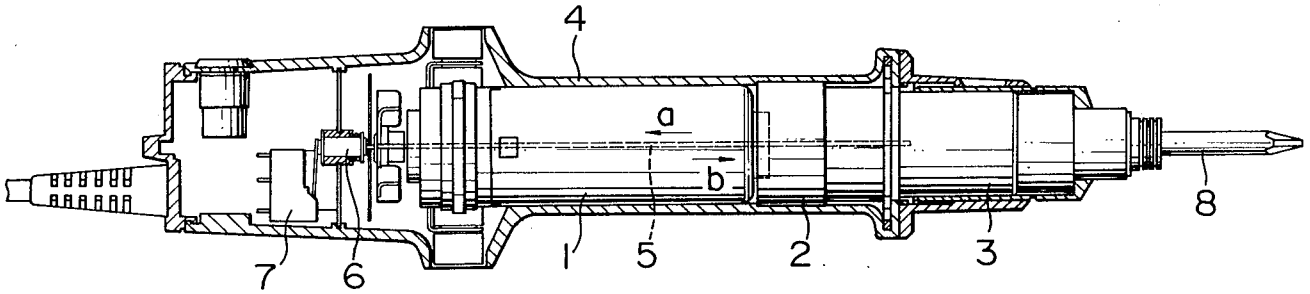
FIG. 9 PRIOR ART
FIG. 9 is a general, sectional view of a prior electrically-operated driver.

As the switch rod 19 moves in the direction of the arrow c, the lever 66 moves in pivotal movement about the shaft 71 in the direction of an arrow e in FIG. 7. The lever 66 presses a flange 72*a* at one end of the pin 72 which is fitted in a U-shaped cutout of the lever 66 and moves the pin 72 in the direction of an arrow g in FIG. 7 against the biasing force of the compression spring 73. At this time, the switch 31 (using a b contact) at an opposite end or forward end of the pin 72 is turned on to cause the motor 9 to start rotating. As the switch rod 19 moves in the direction of an arrow d, the lever 66 moves in pivotal movement in the direction of an arrow f and the pin 72 moves in the direction of an arrow h, to thereby turn off the switch 31 and cause the motor 9 to stop rotating.

The provision of the lever 66 interposed between the intermediate gears 17 and output gear 18 to move the pin 72 to actuate the switch 31 enables the amount of a shift of the switch rod 19 to be positively transmitted to the switch 31.

From the foregoing description, it will be appreciated that the electrically-operated driver according to the invention is provided with switch operating means incorporated in the reduction gearing interposed between the motor and clutch to actuate the switch as the bit moves in the axial direction. By virtue of this feature, the need to use an elongated switch rod extending through a hollow motor shaft is eliminated. Thus, instability of the movement of the switch rod due to its great length, which tends to cause the switch rod to bend, and high cost required for fabricating the hollow motor shaft can be eliminated, and the switch rod has increased rigidity and improved straightness. The switch operating means is located remote from the clutch and close to the switch, so that the switching stroke is not adversely affected by the accumulated errors in the longitudinal dimensions of the parts interposed between them, thereby allowing stability to be achieved in motor startup and suspension.

What is claimed is:

1. A push-start type electrically-operated driver comprising:

a motor;

a reduction gearing for said motor;

a clutch for transmitting drive force from said motor off and on;

a bit adapted to engage a screw, nut and the like for transmitting a torque thereto;

a switch for turning on and off said motor; and a cover for enclosing all the parts of the electrically-operated driver, said motor being turned on as a pressure is applied to said bit to cause a switch rod to move and actuate said switch;

characterized in that:

said reduction gearing comprises a plurality of spur gears, said spur gears each being rotatable about a center axis thereof but prevented from moving in an orbit;

said switch is located close to said reduction gearing; and switch operating means is incorporated in said reduction gearing, said switch operating means being operative to actuate said switch upon said bit moving in an axial direction.

2. A push-start type electrically-operated driver comprising:

a motor;

a reduction gearing for said motor;

a clutch for transmitting drive force from said motor off and on;

a bit adapted to engage a screw, nut and the like for transmitting a torque thereto;

a switch for turning on and off said motor; and a cover for enclosing all the parts of the electrically-operated driver, said motor being turned on as a pressure is applied to said bit to cause a switch rod to move and actuate said switch;

characterized in that:

said reduction gearing comprises a plurality of intermediate gears adapted to mesh with a motor gear, each said intermediate gear having two stages of gear portions and rotatable about a center axis thereof but prevented from moving in an orbit, and an output gear adapted to mesh with the gear portion of the second stage of each said intermediate gear; and switch operating means is incorporated in said reduction gearing, said switch operating means comprising a slide plate interposed between said motor gear and said output gear and movable in sliding movement axially of said intermediate gears as a switch rod moves, a rod connected to a portion of said side plate for turning on and off said switch, guide poles for guiding said slide plate in sliding movement, and an upper plate and a lower plate for supporting said intermediate gears and said guide poles, wherein said slide plate moves in sliding movement to cause the rod connected thereto to actuate said switch in conjunction with the movement of the switch rod extending through a central portion of said output gear to the clutch.

3. A push-start type electrically-operated driver as claimed in claim 2, wherein said slide plate is constantly biased to contact with said switch rod.

4. A push-start type electrically-operated driver comprising:

a motor;

a reduction gearing for said motor;

a clutch for transmitting drive force from said motor off and on;

a bit adapted to engage a screw, nut and the like for transmitting a torque thereto;

a switch for turning on and off said motor; and a cover for enclosing all the parts of the electrically-operated driver, said motor being turned on as a pressure is applied to said bit to cause a switch rod to move and actuate said switch;

characterized in that:

said reduction gearing comprises a plurality of intermediate gears adapted to mesh with a motor gear, each said intermediate gear having two stages of gear portions and rotatable about a center axis thereof but prevented from moving in an orbit, and an output gear adapted to mesh with the gear portion of the second stage of each said intermediate gear; and switch operating means is incorporated in said reduction gearing, said switch operating means comprising an upper plate and a lower plate for supporting said intermediate gears, a plurality of posts for supporting said intermediate gears, upper plate and lower plate, a lever adapted to move in pivotal movement about a shaft supported by a block secured to said posts in conjunction with the movement of the switch rod and a pin adapted to move in sliding movement in said block to turn on and off said switch when said lever moves in pivotal movement, wherein said lever moves in pivotal movement and said pin moves in sliding movement to actuate said switch in conjunction with the movement of the switch rod extending through a central portion of said output gear to the clutch.

5. A push-start type electrically-operated driver as claimed in claim 4, wherein said lever is biased into engagement with said switch rod at all times.

* * * * *